US006849996B2

(12) United States Patent
Venugopal et al.

(10) Patent No.: US 6,849,996 B2
(45) Date of Patent: Feb. 1, 2005

(54) ELECTRODE MATERIALS FOR ELECTRIC LAMPS AND METHODS OF MANUFACTURE THEREOF

(75) Inventors: Shankar Madras Venugopal, Karnataka (IN); Alok M. Srivastava, Niskayuna, NY (US); Holly Ann Comanzo, Niskayuna, NY (US); Vikas Midha, Clifton Park, NY (US); William Winder Beers, Chesterland, OH (US); Gopi Chandran Ramachandran, Karnataka (IN); Mukunda Srinivas Adyam, Karnataka (IN)

(73) Assignee: General Electric Company, Niskayuna, NY (US)

( * ) Notice: Subject to any disclaimer, the term of this patent is extended or adjusted under 35 U.S.C. 154(b) by 21 days.

(21) Appl. No.: 10/452,037

(22) Filed: May 30, 2003

(65) Prior Publication Data

US 2004/0239229 A1 Dec. 2, 2004

(51) Int. Cl.[7] ..... H01J 1/00
(52) U.S. Cl. ..... 313/326; 313/346 R
(58) Field of Search ..... 313/491, 633, 313/326, 346 R

(56) References Cited

U.S. PATENT DOCUMENTS 3,951,874 A 4/1976 Kern ..... 252/521
3,953,376 A 4/1976 Kern
3,969,279 A 7/1976 Kern
5,744,905 A 4/1998 Mehrotra et al. ..... 313/491
5,747,926 A 5/1998 Nakamoto et al.
5,847,497 A 12/1998 Mehrotra et al. ..... 313/346 DC
5,847,498 A * 12/1998 Mehrotra et al. ..... 313/352
5,939,825 A 8/1999 Sun et al.
6,052,160 A 4/2000 Bohmer et al.
6,384,534 B1 5/2002 Srivastava et al. ..... 313/633

* cited by examiner

*Primary Examiner*—Vip Patel
(74) *Attorney, Agent, or Firm*—Fletcher Yoder

(57) ABSTRACT

An electron emissive composition comprises a barium tantalate composition of the formula $(Ba_{1-x}, Ca_x, Sr_p, D_q)_6(Ta_{1-y}, W_y, E_t, F_u, G_v, Ca_w)_2O_{(11\pm\delta)}$ where δ is an amount of about 0 to about −3; and wherein D is either an alkali earth metal ion or an alkaline earth ion; E, F, and G, are alkaline earth ions and/or transition metal ion; x is an amount of up to about 0.7; y is an amount of up to about 1; p and q are amounts of up to about 0.3; and t is an amount of about 0.05 to about 0.10, u is an amount of up to about 0.5, v is an amount of up to about 0.5 and w is an amount of up to about 0.25. A method for manufacturing an electron emissive composition comprises blending a barium tantalate composition with a binder; and sintering the barium tantalate composition with the binder at a temperature of about 1000° C. to about 1700° C.

28 Claims, 12 Drawing Sheets

ELECTRODE MATERIALS FOR ELECTRIC LAMPS AND METHODS OF MANUFACTURE THEREOF

BACKGROUND

This disclosure relates to electrode materials for electric lamps and methods of manufacture thereof.

The standard electron emissive coating currently used in a majority of electrodes of commercial fluorescent lamps contains a mixture of barium, calcium, and strontium oxides ("triple oxide emissive mixture"). Since these oxides are highly sensitive to ambient carbon dioxide and water, they are generally placed on the lamp electrodes initially as a wet mixture suspension of barium, calcium and strontium carbonates containing a binder and a solvent. The wet mixture suspension is then "activated" inside the lamp assembly during the manufacturing process by resistively heating the electrodes until the carbonates decompose, releasing carbon dioxide and some carbon monoxide, and leaving behind a triple oxide emissive mixture on the electrode.

However, the triple oxide emissive mixture suffers from several drawbacks. First, the "activation" requires an undesirably high temperature to convert the carbonates to oxides. The conversion of the carbonates to oxides undesirably releases volatile organics, carbon dioxide and some carbon monoxide. Additionally, lamps having electrodes coated with the triple oxide emissive mixture have a rather short operating lifetime. It is therefore desirable to have electrodes coated with an electron emissive mixture, which are more robust and have a longer life cycle.

SUMMARY

In one embodiment, an electron emissive composition comprises a barium tantalate composition of the formula (I)

$$(Ba_{1-x}, Ca_x, Sr_p, D_q)_6(Ta_{1-y}, W_y, E_t, F_u, G_v, Ca_w)_2O_{(11\pm\delta)} \quad (I)$$

wherein δ is an amount of about 0 to about 6; and wherein D is either an alkali earth metal ion or an alkaline earth metal ion; E, F, and G are alkali earth metal ions, alkaline earth metal ions and/or transition metal ions; x is an amount of up to about 0.7; y is an amount of up to about 1; p and q are amounts of up to about 0.3; and t is an amount of about 0.05 to about 0.10; u is an amount of up to about 0.5; v is an amount of up to about 0.5 and w is an amount of up to about 0.25.

In another embodiment, a method for manufacturing an electron emissive composition comprises blending a barium tantalate composition of the formula (I)

$$(Ba_{1-x}, Ca_x, Sr_p, D_q)_6(Ta_{1-y}, W_y, E_t, F_u, G_v, Ca_w)_2O_{(11\pm\delta)} \quad (I)$$

wherein δ is an amount of about 0 to about 6; and wherein D is either an alkali earth metal ion or an alkaline earth metal ion; E, F, and G are alkali earth metal ions, alkaline earth metal ions and/or transition metal ions; x is an amount of up to about 0.7; y is an amount of up to about 1; p and q are amounts of up to about 0.3; and t is an amount of about 0.05 to about 0.10; u is an amount of up to about 0.5; v is an amount of up to about 0.5 and w is an amount of up to about 0.25; with a binder; and sintering the barium tantalate composition with the binder at a temperature of about 1000° C. to about 1700° C.

In yet another embodiment, an electrode comprises a substrate; and a barium tantalate composition disposed upon the substrate, wherein the barium tantalate composition has the formula (I)

$$(Ba_{1-x}, Ca_x, Sr_p, D_q)_6(Ta_{1-y}, W_y, E_t, F_u, G_v, Ca_w)_2O_{(11\pm\delta)} \quad (I)$$

wherein δ is an amount of about 0 to about 6; and wherein D is either an alkali earth metal ion or an alkaline earth metal ion; E, F, and G are alkali earth metal ions, alkaline earth metal ions and/or transition metal ions; x is an amount of up to about 0.7; y is an amount of up to about 1; p and q are amounts of up to about 0.3; t is an amount of about 0.05 to about 0.0; u is an amount of up to about 0.5; v is an amount of up to about 0.5 and w is an amount of up to about 0.25.

DETAILED DESCRIPTION OF PREFERRED EMBODIMENTS

Figure 1:
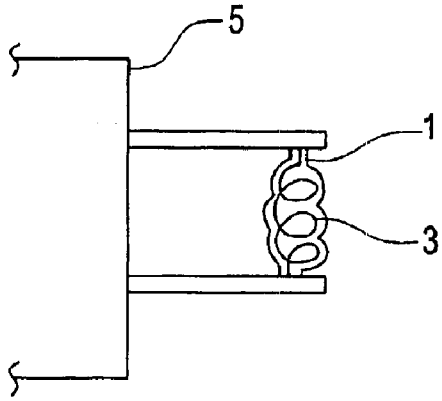
FIG. 1 is a side cross-sectional view of a coil electrode having the electron emissive composition.

Disclosed herein is an electron emissive composition comprising a barium tantalate composition. These electron emissive compositions combine good electron emissive characteristics with a lower evaporation rate and a high sputter resistance. In addition, the electron emissive composition is stable in an organic binder and/or water and does not decompose or undergo any physical or chemical changes. They can be advantageously stored in the binder and/or water for several months. In addition, they may advantageously be used in electrodes in linear fluorescent, circular fluorescent, compact fluorescent, high intensity discharge lamps, flat panel displays, mercury free and xenon lamps.

The barium tantalate composition advantageously has the formula (I)

$$(Ba_{1-x}, Ca_x, Sr_p, D_q)_6(Ta_{1-y}, W_y, E_t, F_u, G_v, Ca_w)_2O_{(11\pm\delta)} \quad (I)$$

where δ is an amount of about 0 to about 6; and Ba, Ca, Sr, Ta, and W are barium, calcium, strontium, tantalum and tungsten respectively, and D may be either an alkali earth metal ion or an alkaline earth metal ion, while E, F, and G, may be either alkali earth metal ions, alkaline earth metal ions and/or transition metal ions. In the formula (I) above, x represents an amount of up to about 0.7, while y represents an amount of up to about 1, p and q represents amounts of up to about 0.3 and t represents amounts of about 0.05 to about 0.10, u represents amounts of up to about 0.5, v represents amounts of up to about 0.5 and w represents amounts of up to about 0.25. In an exemplary embodiment, D is preferably magnesium, E is preferably zirconium (Zr), F is preferably niobium (Nb), and G is preferably titanium (Ti).

Within these ranges, it is generally desirable to have x greater than or equal to about 0.25, and preferably greater than or equal to about 0.3. Also desirable within this range is a value of less than or equal to about 0.4, preferably less than or equal to about 0.38. It is generally desirable to have y less than or equal to about 0.5, preferably less than or equal to about 0.3, and more preferably less than or equal to about 0.1. It is also generally desirable to have y greater than or equal to about 0.01, preferably greater than or equal to about 0.03, and more preferably greater than or equal to about 0.05. It is generally desirable to have p and q less than or equal to about 0.25, preferably less than or equal to about 0.15, and more preferably less than or equal to about 0.1. It is also generally desirable to have p and q greater than or equal to about 0.01, preferably greater than or equal to about 0.05. It is also desirable to have u and v less than or equal to about 0.4, preferably less than or equal to about 0.25. It is also desirable to have u and v greater than or equal to about 0.01, preferably greater than or equal to about 0.02. It is also desirable to have w less than or equal to about 0.15, preferably less than or equal to about 0.10. Similarly it may be desirable to have w greater than or equal to about 0.01, preferably greater than or equal to about 0.05. The preferred barium tantalate compositions are those wherein x in the formula (1) has a value of greater than or equal to about 0.25 and less than or equal to about 0.35, y represents an amount of either 0 or 1 and p, q, t, u, v and w are each equal to 0.

The preferred alkali metal ions and alkaline earth metal ions in the barium tantalate composition are sodium, potassium, cesium, rubidium, magnesium, calcium, strontium, or barium. The barium tantalate composition of the formula (I) may be derived from metal compounds such as the respective oxides, peroxides, carbonates, nitrates, carboxylates, sulfates, chlorides, or the like, or one of the metal compounds used in the barium tantalate composition. In an exemplary embodiment, these metals are derived from the carboxylates, carbonates, oxides and nitrates.

The metal compounds used in the preparation of the barium tantalate composition may be ground up into the desired particle sizes using a combination of shear and compressive forces in devices such as ball mills, Henschel mixers, Waring blenders, roll mills, and the like. The metal compounds may be ground up for a time period effective to produce particles of about 0.4 to about 8 micrometers. Within this range it is generally desirable to have the particle size greater than or equal to about 0.8 micrometers, preferably greater than or equal to about 1 micrometer, and more preferably greater than or equal to about 1.5 micrometers. Within this range, it is also desirable to have the particle size less than or equal to about 7 micrometers, preferably less than or equal to about 6 micrometers, and more preferably less than or equal to about 5 micrometers.

In an exemplary embodiment, in one manner of proceeding with the preparation of barium tantalate compositions for use in an electron emissive composition, the starting barium, tantalum, calcium, and/or tungsten powders such as a barium carbonate ($BaCO_3$) powder, a tantalum pentoxide ($Ta_2O_5$) powder, a calcium carbonate ($CaCO_3$) powder and/or a tungsten trioxide ($WO_3$) powder are mixed in a stoichiometric proportion to obtain a first powder having the desired ratio of efficacy to operating lifetime. Preferably, the tantalum pentoxide powder is milled prior to the mixing step such that its median particle size is 4 micrometers or less to enhance its reactivity. The first (i.e., mixed) powder is then subjected to a first sintering process to form a sintered body or "cake" which has the requisite barium tantalate composition. Preferably, the first sintering process takes place in a furnace at a temperature of about 1500° C. for about 10 hours. However, other appropriate sintering temperatures and durations may also be used if desired.

The sintered body having the barium tantalate composition is then milled to form a second powder. The second powder is preferably milled in propanol or water as the milling media or liquid and subsequently dried. However, other milling media, such as methanol, for example, may be used instead. Optionally, zirconium and/or strontium may be added to the first powder or to the second powder as zirconium oxide or strontium carbonate powders.

The second powder having the barium tantalate composition utilizes particles in a size of about 1 to about 20 micrometers. Within this range, it is generally desirable to have the barium tantalate composition particle size greater than or equal to about 1.5 micrometers, preferably greater than or equal to about 1.8 micrometers, and more preferably greater than or equal to about 2 micrometers. Within this range, it is also desirable to have the barium tantalate composition particle sizes of less than or equal to about 15 micrometers, preferably less than or equal to about 10 micrometers, and more preferably less than or equal to about 5 micrometers.

In one embodiment, metals that are suitable for use as activator additives may be optionally added to the barium tantalate composition to facilitate the formation of the electron emissive composition during the sintering. Group VIIIa transition metals such as nickel, platinum, palladium, rhodium, ruthenium, iron, cobalt, copper and nickel may be used as activator additives. Suitable sintering aids or activator additives include at least one other oxide such as titania ($TiO_2$) or Zirconia ($ZrO_2$), which leads to liquid phase sintering of the oxide phase in the composite. Other liquid phase sintering aids for the mixed oxides such as lithium fluoride (LiF), lithium sulfate, potassium chloride, may also be used. In an exemplary embodiment pertaining to the use of activator additives, zirconia ($ZrO_2$) may be added in an amount of up to about 2 wt % based on the total weight of the barium tantalate composition.

The electron emissive composition may generally be manufactured by various processing methods utilized in the fields of ceramics and metallurgy. The barium tantalate composition may also be manufactured by a variety of different methods, all of which generally permit good control over particle size and crystallinity. Suitable examples of such manufacturing processes are the oxalate decomposition method, reactive milling method, sol-gel method, wet chemical precipitation, molten-salt synthesis and mechanochemical synthesis. In one exemplary embodiment, a composite comprising the barium tantalate composition can also be disposed as a thin or a thick film on a tungsten substrate through a sol-gel process or other physical and/or chemical thin-film deposition methods.

As stated above, powders of the barium tantalate compositions are generally first mechanically milled if desired, to form an electron emissive precursor composition having particles of a desired size. The particles of the electron emissive precursor composition are then blended with a binder and optionally a solvent to form a wet mixture. Mechanical milling may continue during the formation of the wet mixture. The wet mixture as defined herein may be either a slurry, suspension, solution, paste, or the like. The wet mixture is then coated onto a desired substrate, following which it is optionally allowed to dry to form a green coating. The green coating is a coating which generally has less than or equal to about 10 wt % solvent based upon the weight of the wet mixture. It preferably has less than or equal to about 5 wt %, preferably less than 3 wt % and more preferably less than or equal to about 2 wt % solvent, based on the total weight of the wet mixture. The substrate with the wet mixture or the green coating is then annealed to facilitate sintering to form the electron emissive composition.

The binders used in the preparation of the wet mixture are polymeric resins, ceramic binders, or combinations comprising polymeric resins and ceramic binders. Polymeric resins used in the preparation of the wet mixture may be thermoplastic resins, thermosetting resins or combinations of thermoplastic resins with thermosetting resins. The thermoplastic resins may be oligomers, polymers, copolymers such as block copolymers, graft copolymers, random copolymers, star block copolymers, dendrimers, polyelectrolytes, ionomers or the like, or combinations comprising at least one of the foregoing thermoplastic resins. Suitable examples of thermoplastic resins are polyacetal, polyacrylic, styrene acrylonitrile, acrylonitrile-butadiene-styrene (ABS), polycarbonates, polystyrenes, polyethylene, polypropylenes, polyethylene terephthalate, polybutylene terephthalate, polyamides, polyamideimides, polyarylates, polyurethanes, polyetherimide, polytetrafluoroethylene, fluorinated ethylene propylene, perfluoroalkoxy polymers, polyethers such as polyethylene glycol, polypropylene glycol, or the like; polychlorotrifluoroethylene, polyvinylidene fluoride, polyvinyl fluoride, polyetherketone, polyether etherketone, polyether ketone ketone, nitrocellulose, cellulose, lignin, or the like, or combinations comprising at least one of the foregoing thermoplastic resins. The preferred thermoplastic resin is nitrocellulose.

It is generally desirable to use thermoplastic resins having a number average molecular weight of about 1000 grams per mole (g/mole) to about 500,000 g/mole. Within this range, it is desirable to use a thermoplastic resin having a number average molecular weight of greater than or equal to about 2,000, preferably greater than or equal to about 3,000 and more preferably greater than or equal to about 4,000 g/mole. Also desirable within this range is a molecular weight of less than or equal to about 200,000, preferably less than or equal to about 100,000 and more preferably less than or equal to about 50,000 g/mole.

Examples of blends of thermoplastic resins include acrylonitrile-butadiene-styrene/nylon, polycarbonate/acrylonitrile-butadiene-styrene, acrylonitrile butadiene styrene/polyvinyl chloride, polyphenylene ether/polystyrene, polyphenylene ether/nylon, polycarbonate/thermoplastic urethane, polycarbonate/polyethylene terephthalate, polycarbonate/polybutylene terephthalate, polyethylene terephthalate/polybutylene terephthalate, styrene-maleicanhydride/acrylonitrile-butadiene-styrene, polyethylene/nylon, polyethylene/polyacetal, or the like, or combinations comprising at least one of the foregoing blends of thermoplastic resins.

Specific non-limiting examples of polymeric thermosetting materials include polyurethanes, epoxy, phenolic, polyesters, polyamides, silicones, or the like, or combinations comprising at least one of the foregoing thermosetting resins.

Ceramic binders may also be used in the preparation of the wet mixture. Examples of ceramic binders are aluminum phosphate, zirconia, zirconium phosphate, silica, magnesia and the like. The binders are generally used in an amount of about 5 to about 50 wt % based on the total weight of the wet mixture. Within this range, the binders are generally present in the wet mixture in an amount of greater than or equal to about 8 wt %, preferably greater than or equal to about 10 wt %, and more preferably greater than or equal to about 12 wt % based on the total weight of the wet mixture. Within this range, the binders are generally present in the wet mixture in an amount of less than or equal to about 45, preferably less than or equal to about 40, and more preferably less than or equal to about 35 wt % based on the total weight of the wet mixture.

Solvents may optionally be used in the preparation of the wet mixture. Liquid aprotic polar solvents such as propylene carbonate, ethylene carbonate, butyrolactone, acetonitrile, benzonitrile, nitromethane, nitrobenzene, sulfolane, dimethylformamide, N-methylpyrrolidone, butyl acetate, amyl acetate, methyl propanol or propylene glycol monomethyl ether acetate with denatured ethanol, or the like, or combinations comprising at least one of the foregoing solvents may generally be used in the preparation of the wet mixture. Polar protic solvents such as water, methanol, acetonitrile, nitromethane, ethanol, propanol, isopropanol, butanol, or the like, or combinations comprising at least one of the foregoing polar protic solvents may also be used in the preparation of the wet mixture. Other non-polar solvents such a benzene, toluene, methylene chloride, carbon tetrachloride, hexane, diethyl ether, tetrahydrofuran, or the like, or combinations comprising at least one of the foregoing solvents may also be used in the preparation of the wet mixture. Co-solvents comprising at least one aprotic polar solvent and at least one non-polar solvent may also be utilized to prepare the wet mixture. Ionic liquids may also be utilized for preparing the wet mixture. The preferred solvent is propylene glycol mono-methyl ether acetate with denatured ethanol. It is generally desirable for the preferred solvent to comprise about 90 to about 95 wt % of propylene glycol mono-methyl ether acetate with about 1 to about 2 wt % of the denatured alcohol.

The solvent is generally used in an amount of about 5 to about 60 wt % based on the total weight of the wet mixture. Within this range, the solvent is generally present in the wet mixture in an amount of greater than or equal to about 8, preferably greater than or equal to about 10, and more preferably greater than or equal to about 12 wt % based on the total weight of the wet mixture. Within this range, the solvent is generally present in the wet mixture in an amount of less than or equal to about 48, preferably less than or equal to about 45, and more preferably less than or equal to about 40 wt % based on the total weight of the wet mixture.

The wet mixture is generally coated onto a desired substrate such as a tungsten wire or sheet and is then sintered. The substrate may generally be used an electrode for use in a lamp. The coating of the substrate is carried out by processes such as dip coating, spray painting, electrostatic painting, painting with a brush, or the like. The preferred method of coating is dip coating. The coating thickness is generally about 3 micrometers to about 100 micrometers after sintering. Within this range a coating thickness of greater than or equal to about 4 micrometers, preferably greater than or equal to about 5 micrometers, and more preferably greater than or equal to about 8 micrometers is desirable. Also desirable is a coating thickness of less than or equal to about 95 micrometers, preferably less than or equal to about 75 micrometers, and more preferably less than or equal to about 60 micrometers.

The coated substrate is generally subjected to second sintering process to remove the solvent and binder and to form a coating of the electron emissive composition on the substrate. The second sintering process may be conducted by heating process such as conduction, convection, radiation such as radio frequency radiation or microwave radiation. In another embodiment, the electrode may be resistively heated to form the electron emissive composition. Combinations of different methods of heating for purposes of sintering, such as for example, convective heating with resistive heating may also be used if desired. The sintering by conduction, convection, radiation, resistive heating or combinations thereof may be carried out at a temperature of about 1000 to about 1700° C. Within this range it is generally desirable to use a temperature of greater than or equal to about 1100° C., preferably greater than or equal to about 1200° C., and more preferably greater than or equal to about 1300° C. Also desirable within this range is a temperature of less than or equal to about 1650° C., preferably less than or equal to about 1625° C., preferably less than or equal to about 1600° C., and more preferably less than or equal to about 1550° C. The preferred temperature for sintering is about 1500° C. The preferred method for sintering is by the use of convective heat.

Alternatively, the sintering may be conducted in a two stage process if desired. In the first stage, the binder may be eliminated by heating the wet mixture of the green coating to a temperature of about 300° C. to about 400° C. for about 10 to about 60 minutes. In the second stage the material is sintered to a temperature of about 1000° C. to about 1700° C.

The substrate may have any desired shape. It may be either 1-dimensional, 2-dimensional or 3-dimensional or any suitable dimension up to about 3, such as a fractional dimension. Suitable examples of 1-dimensional substrates are linear filaments, non-linear filaments such as circular filaments, elliptical filaments, coiled filaments or the like. Suitable examples of 2-dimensional substrates are flat plates, flat or curved sheets, and the like. Suitable examples of 3-dimensional substrates are hollow spheres, cups, beads, and the like. It may also be possible to use substrates having a combination of 1, 2, or 3-dimensional geometries. The preferred filament is a tungsten filament. In an exemplary embodiment, the substrate is used as an electrode in a lamp. The electrode may be either and anode or a cathode or both if so desired.

Figure 2:
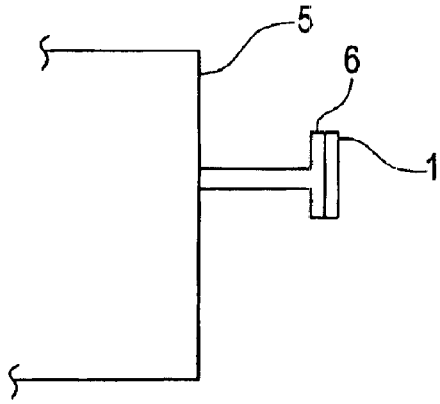
FIG. 2 is a side cross-sectional view of a flat member cathode having the electron emissive composition.
Figure 3:
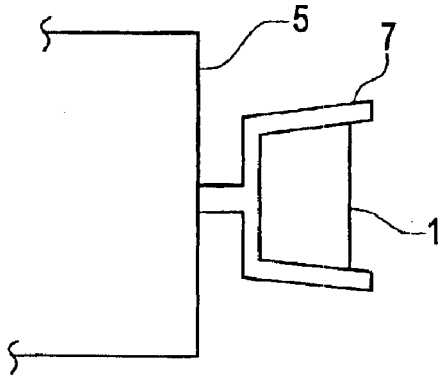
FIG. 3 is a side cross-sectional view of a cup shaped cathode having the electron emissive composition.
Figure 4:
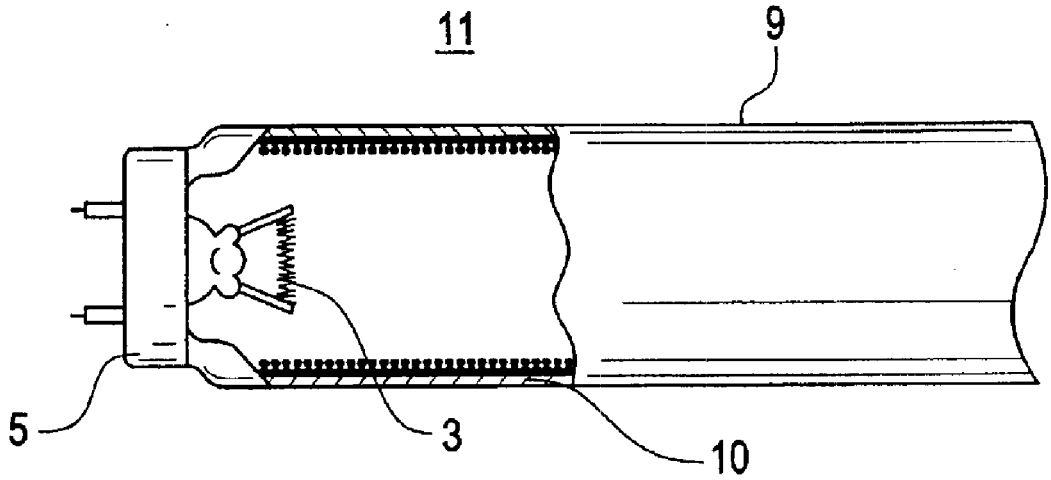
FIG. 4 is a side cross-sectional view of a linear fluorescent lamp having the electron emissive composition.
Figure 5:
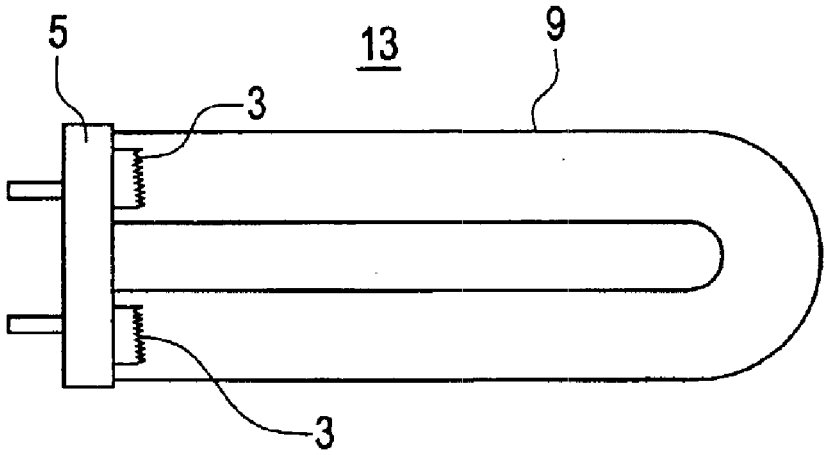
FIG. 5 is a side cross-sectional view of a compact fluorescent lamp having the electron emissive composition.
Figure 6:
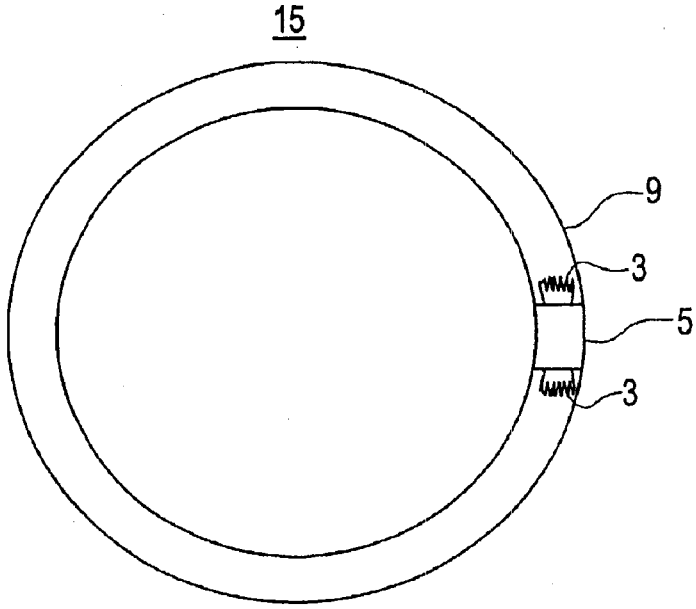
FIG. 6 is a top cross-sectional view of a circular fluorescent lamp having the electron emissive composition.
Figure 7:
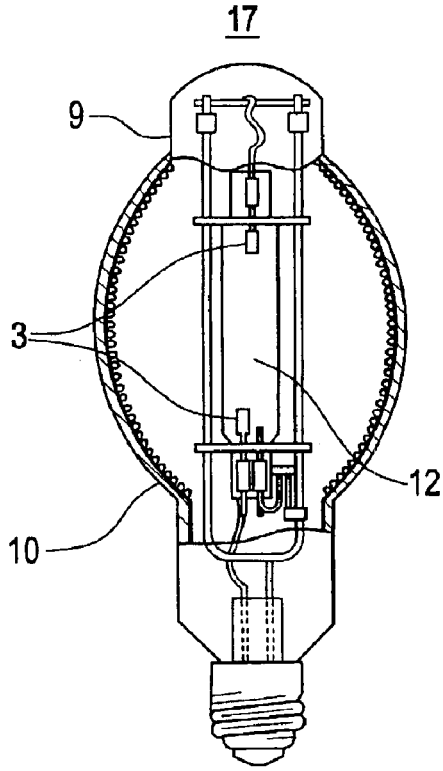
FIG. 7 is a side cross-sectional view of a high pressure fluorescent lamp having the electron emissive composition.

Various embodiments of lamps are depicted in the FIGS. 1–7. These embodiments show how the electron emissive composition may be utilized in various cathode configurations. The applications of the electron emissive compositions are not intended to be limited to the depicted embodiments. The cathode may comprise a wire or a coil 3, such as a tungsten coil illustrated in FIG. 1, connected to a ballast 5. Alternatively, the cathode may comprise a flat member 6 containing the emissive mixture 1 on at least one surface, as illustrated in FIG. 2, or a cup 7 containing the emissive mixture 1 inside the hollow interior space, as illustrated in FIG. 3. The lamp may comprise any lamp, preferably a florescent lamp containing a cathode 3, ballast 5 and a gas containing envelope or cover 9. The interior surface of the envelope may be coated with the electron emissive composition 10. The fluorescent lamp may comprise a linear fluorescent lamp 11 illustrated in FIG. 4, a compact fluorescent lamp 13, illustrated in FIG. 5, or a circular fluorescent lamp 15, illustrated in FIG. 6. Alternatively, the lamp may comprise a high-pressure lamp 17 containing an inner gas envelope 12 inside the outer cover or bulb 9, as illustrated in FIG. 7.

The electron emissive composition may be advantageously used in an electrode of a fluorescent lamp. The electron emissive composition generally has a lower evaporation rate, higher sputter-resistance and easier activation than the currently used tricarbonates. The work function of the electron emissive composition is in an amount of about 1.6 electron-Volt (eV) to about 2.5 (eV). Within this range it is desirable to have a work function of less than or equal to about 2.4, preferably less than or equal to about 2.2, and more preferably less than or equal to about 2.0 eV. The low function of the electrode generally permits the use of low cost ballast topologies. The electron emissive composition generally permits an increased life cycle because of better adhesion to a tungsten substrate.

The application of the wet mixture to the electrode and its subsequent sintering outside the lamp advantageously prevents the evolution of carbon dioxide during activation of the lamp and therefore reduces the variability in performance of the lamp. Since the barium tantalate composition is insensitive to moisture, the resulting electron emissive composition does not produce any dark oxide bands during emission.

The following examples, which are meant to be exemplary, not limiting, illustrate compositions and methods of manufacturing some of the various embodiments of the environmentally resistant coatings using various materials and apparatus.

EXAMPLES

In this experiment, several different barium tantalate compositions were prepared by using the appropriate precursors shown in Table 1 and mixing them in the stoichiometry determined by the compositions shown in Table 2. The samples were prepared by mixing the precursors in a laboratory rack mill to from a first powder. The average particle size of the first powder was about 1 to about 2 micrometers. The first powder was then sintered at 1500° C. for 10 hours to form the barium tantalate composition. The barium tantalate composition was then ground up into a second powder having a particle size of 4 micrometers, which then tested in a binder or in water. It is to be noted that the barium tantalate compositions containing calcium in an amount of greater than or equal to about 25 atomic percent generally produce fine particles having an average size of about 3 to about 4 micrometers and therefore do not need any further milling except for blending it with the binder and solvent to form the wet mixture.

The samples were then evaluated for stability in water and in the binder by aging them for three weeks in either water or the binder. It is generally desirable to have electron emissive compositions, which are either moisture stable (i.e., they do not change structure upon exposure to moisture) or are stable in the binder or are stable in moisture as well as in the binder.

TABLE 1

| Element | Precursor | Commercially Available from |
|---|---|---|
| Barium | Barium Carbonate* | Aldrich, Merck, Alfa Aesar |
| Calcium | Calcium carbonate* | Aldrich, Merck, GE's Ivanhoe Road Plant |
| Strontium | Strontium carbonate | Aldrich, Merck, |
| Tantalum | Tantalum pentoxide | Aldrich, Merck, Alfa Aesar |

*Barium nitrates can also be used in lieu of barium carbonate.

Figure 10:
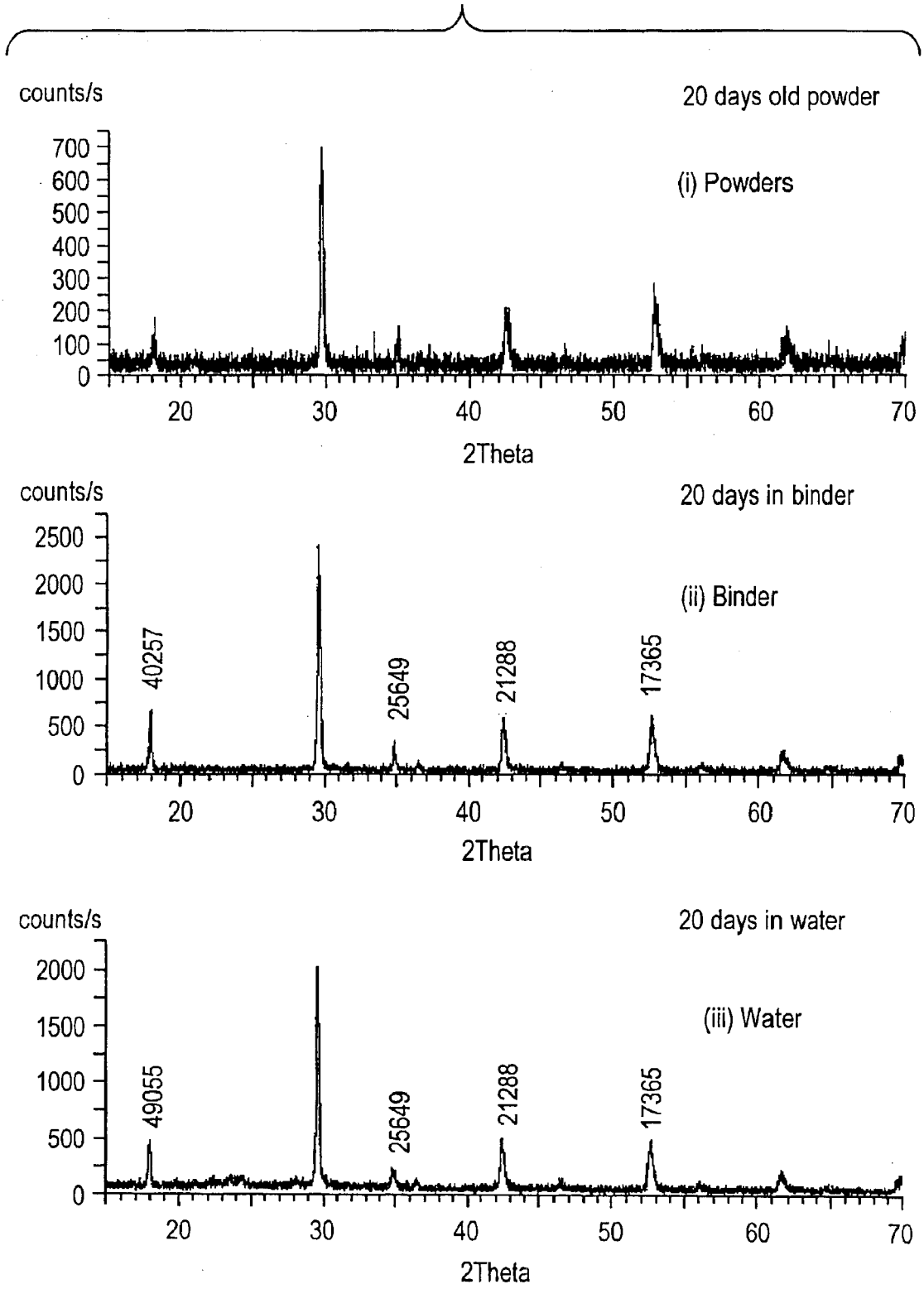
FIG. 10 is a graphical representation of the XRD pattern of Sample # 9 from Table 2 having the composition $(Ba_{0.70}Ca_{0.30})_6Ta_2O_{11}$ after being aged as powder i) in air ii) in the binder and iii) in water for 3 weeks.

FIG. 10 reflects the XRD pattern of Sample # 9 having the composition $(Ba_{0.70}Ca_{0.30})_6Ta_2O_{11}$. The XRD pattern shows that the sample is stable in both water and the binder. These results show that with the addition of calcium in an amount of greater than or equal to about 25 atomic percent (i.e., where x is greater than or equal to about 0.25 in formula (1)) the barium tantalate compositions become water stable an produce fine particulate sizes of about 3 to about 4 micrometers.

Figure 11:
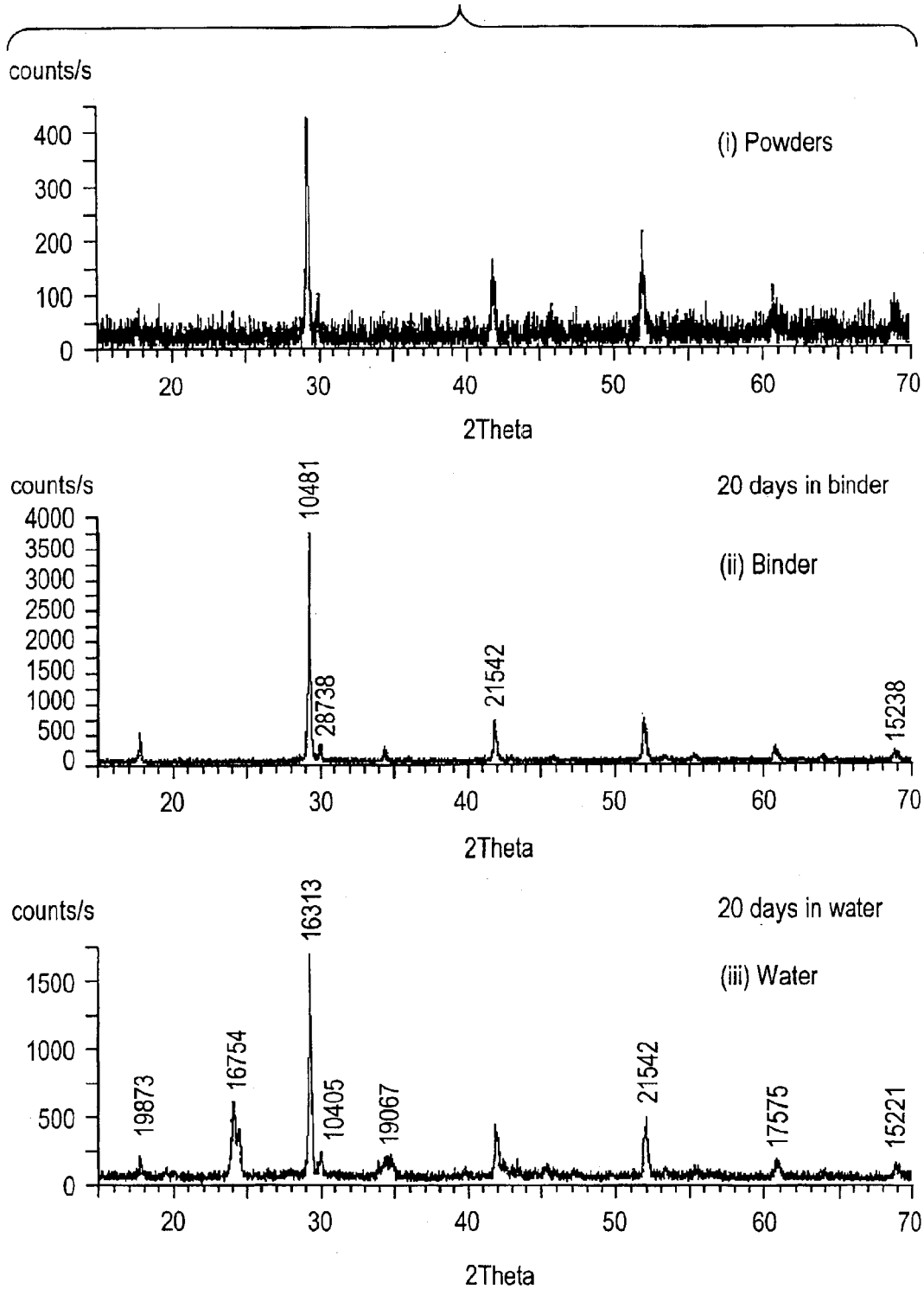
FIG. 11 is a graphical representation of the XRD pattern of Sample # 12 from Table 2 having the composition $(Ba_{0.70}Ca_{0.20}Sr_{0.10})_6Ta_2O_{11}$ after being aged as powder i) in air ii) in the binder and iii) in water for 3 weeks.

FIG. 11 reflects the XRD pattern of Sample # 12 having the composition $(Ba_{70}Ca_{0.20}Sr_{10})_6Ta_2O_{11}$. The XRD pattern shows that the sample is stable in the binder, but its stability to water is reduced when compared with Sample #9 in FIG. 10. These results show that with the addition of strontium in an amount of greater than or equal to about 10 atomic percent (i.e., where p is greater than or equal to about 0.1 in formula (1)) the barium tantalate compositions again become unstable in water.

TABLE 2

| Sample No. | Composition | Phase | Comments |
|---|---|---|---|
| 1 | $Ba_6Ta_2O_{11}$ | Tetragonal | δ - phase, material degraded in water and ambient air |
| 2 | $Ca_6Ta_2O_{11}$ | Mixed | Stability study not performed; |
| 3 | $Sr_6Ta_2O_{11}$ | Mixed | Stability study not performed; |
| 4 | $(Ba_{.95}Ca_{.05})_6Ta_2O_{11}$; x = 0.05 | Tetragonal | a = 6.14, c = 8.70 Å; Not stable in water but stable in binder |
| 5 | $(Ba_{.90}Ca_{.10})_6Ta_2O_{11}$; x = 0.10 | Tetragonal | a = 6.09, c = 8.63 Å; Not stable in water but stable in binder |
| 6 | $(Ba_{.85}Ca_{.15})_6Ta_2O_{11}$; x = 0.15 | Tetragonal | a = 6.06, c = 8.46 Å; Not stable in water but stable in binder |
| 7 | $(Ba_{.80}Ca_{.20})_6Ta_2O_{11}$; x = 0.20 | Tetragonal | a = 6.04, c = 8.46 Å; Not stable in water but stable in binder |
| 8 | $(Ba_{.75}Ca_{.25})_6Ta_2O_{11}$; x = 0.25 | Cubic | a = 8.51 Å;; stable in binder and water |
| 9 | $(Ba_{.70}Ca_{.30})_6Ta_2O_{11}$; x = 0.30 | Cubic | a = 8.45 Å; stable as powder, in water and organic solvents for more than 3 months |
| 10 | $(Ba_{.65}Ca_{.35})_6Ta_2O_{11}$; x = 0.35 | Cubic | a = 8.44 Å; stable in water and binder |
| 11 | $(Ba_{.90}Sr_{.10})_6Ta_2O_{11}$ | Tetragonal | Not stable in water but stable in binder |
| 12 | $(Ba_{.70}Ca_{.20}Sr_{0.10})_6Ta_2O_{11}$ | Tetragonal | Not stable in water but stable in binder |
| 13 | $(Ba_{0.7}Sr_{0.3})_6Ta_2O_{11}$ | Tetragonal | Stability was not studied; |
| 14 | $(Ba_{0.8}Ca_{0.1}Sr_{0.1})_6Ta_2O_{11}$ | Tetragonal | Stability was not studied; |
| 15 | $(Ba_{0.6}Ca_{0.1}Sr_{0.3})_6Ta_2O_{11}$ | Cubic | Stability was not studied; |
| 16 | $(Ba_{0.5}Ca_{0.3}Sr_{0.2})_6Ta_2O_{11}$ | Cubic | Stability was not studied; |
| 17 | $(Ba_{0.6}Ca_{0.3}Sr_{0.1})_6Ta_2O_{11}$ | Cubic | Stability was not studied; |

Figure 8:
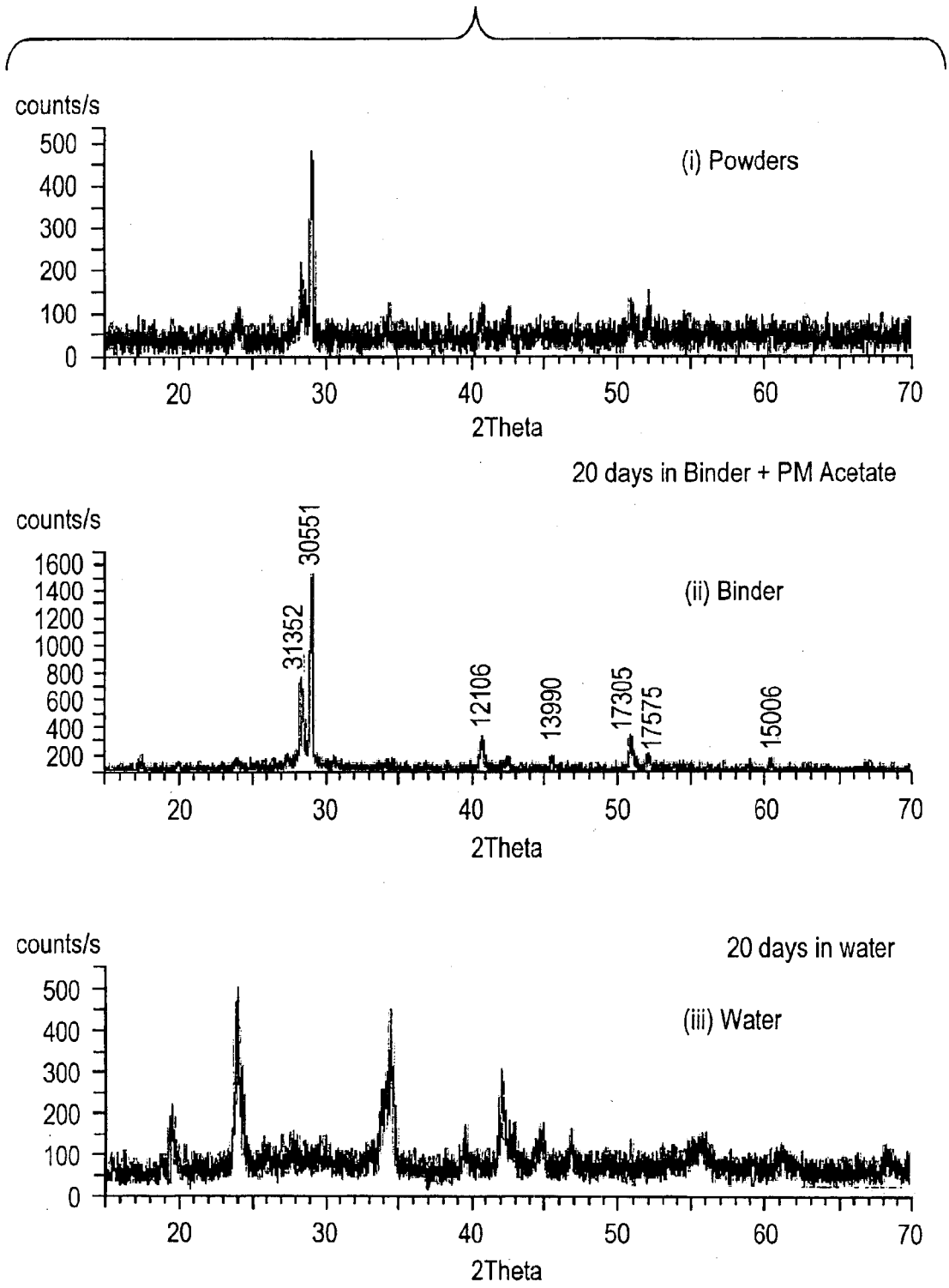
FIG. 8 is a graphical representation of the XRD patterns of Sample #1 from Table 2 having the composition $Ba_6Ta_2O_{11}$ after being aged as powder i) in air ii) in the binder and iii) in water for 3 weeks.

When Sample #1 having the composition $Ba_6Ta_2O_{11}$ was aged in water, for three weeks and tested, it was seen that the sample underwent a change in the crystalline structure as measured by xray diffraction (XRD). These changes are shown in the FIG. 8, which represents XRD patterns of the material after being aged in the binder and in water. While there is no change in the XRD pattern for the $Ba_6Ta_2O_{11}$ in the binder, there is a substantial change in the pattern obtained from the sample exposed to water.

Figure 9:
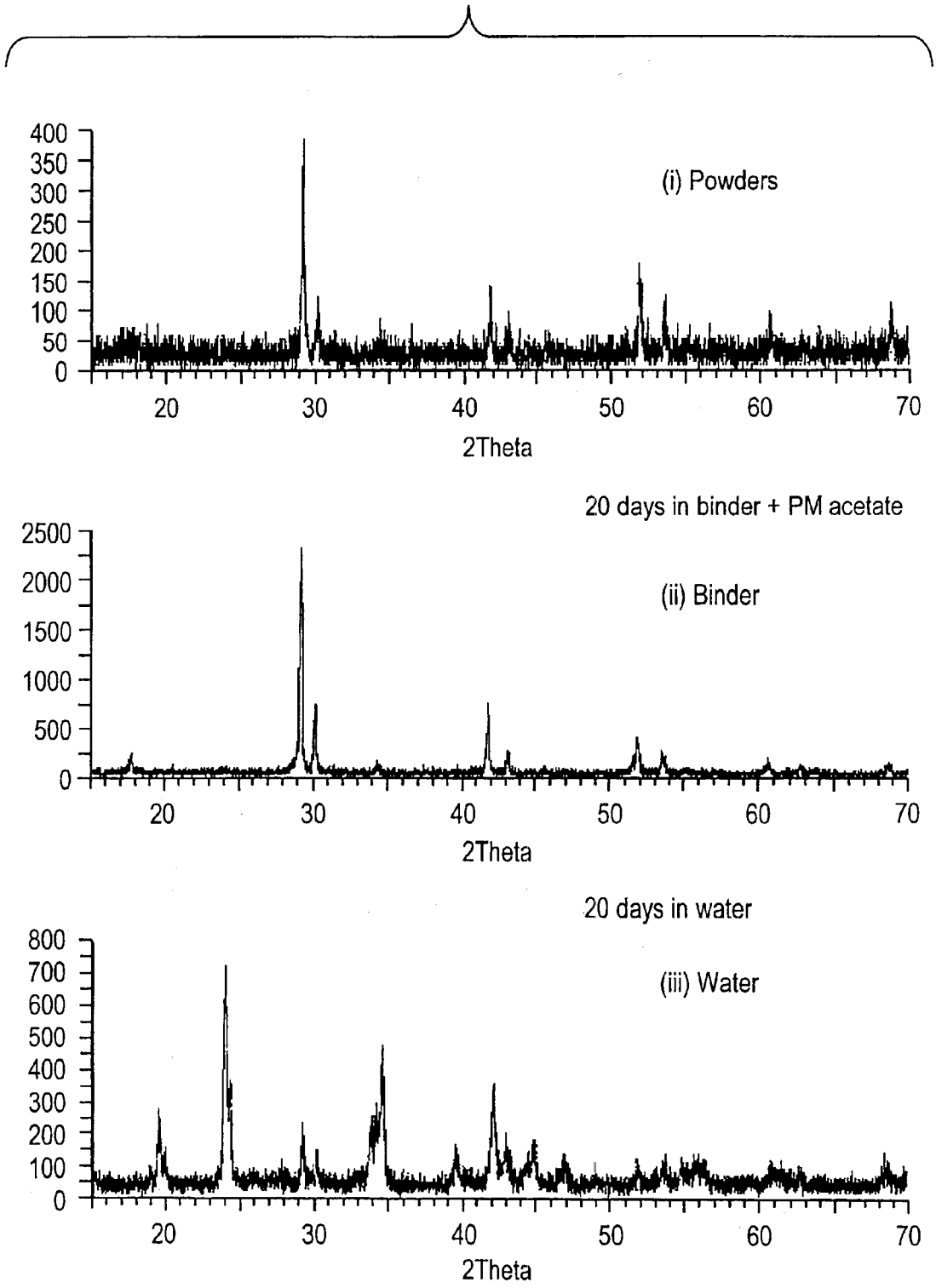
FIG. 9 is a graphical representation of the XRD pattern of Sample # 5 from Table 2 having the composition $(Ba_{0.90}Ca_{0.10})_6Ta_2O_{11}$ after being aged as powder i) in air ii) in the binder and iii) in water for 3 weeks.

FIG. 9 reflects the XRD pattern of Sample # 5 having the composition $(Ba_{0.90}Ca_{0.10})_6Ta_2O_{11}$. The XRD pattern shows results similar to those shown by the Sample #1, i.e. while the composition is stable in the binder, it shows instability in water as evidenced due to the presence of additional peaks in the XRD pattern.

Figure 12:
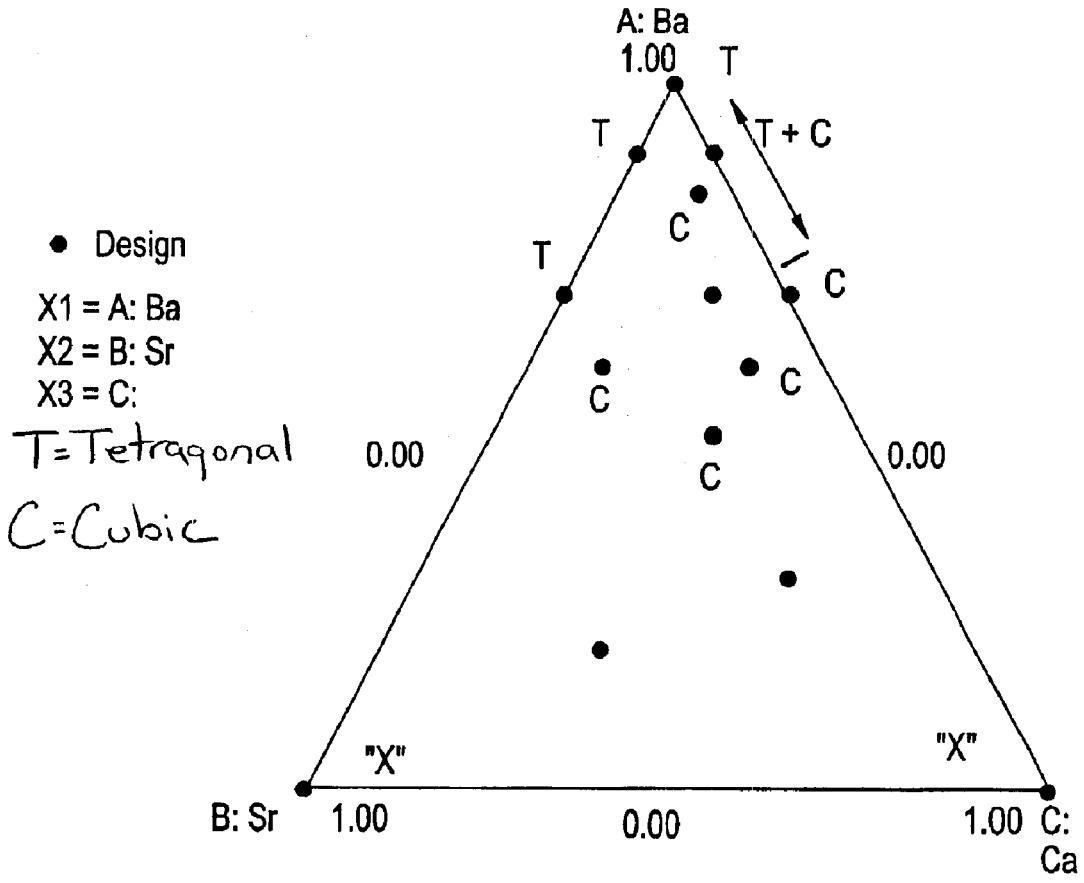
FIG. 12 is a phase diagram for a barium tantalate composition comprising barium, strontium, calcium and tantalum.
Figure 13:
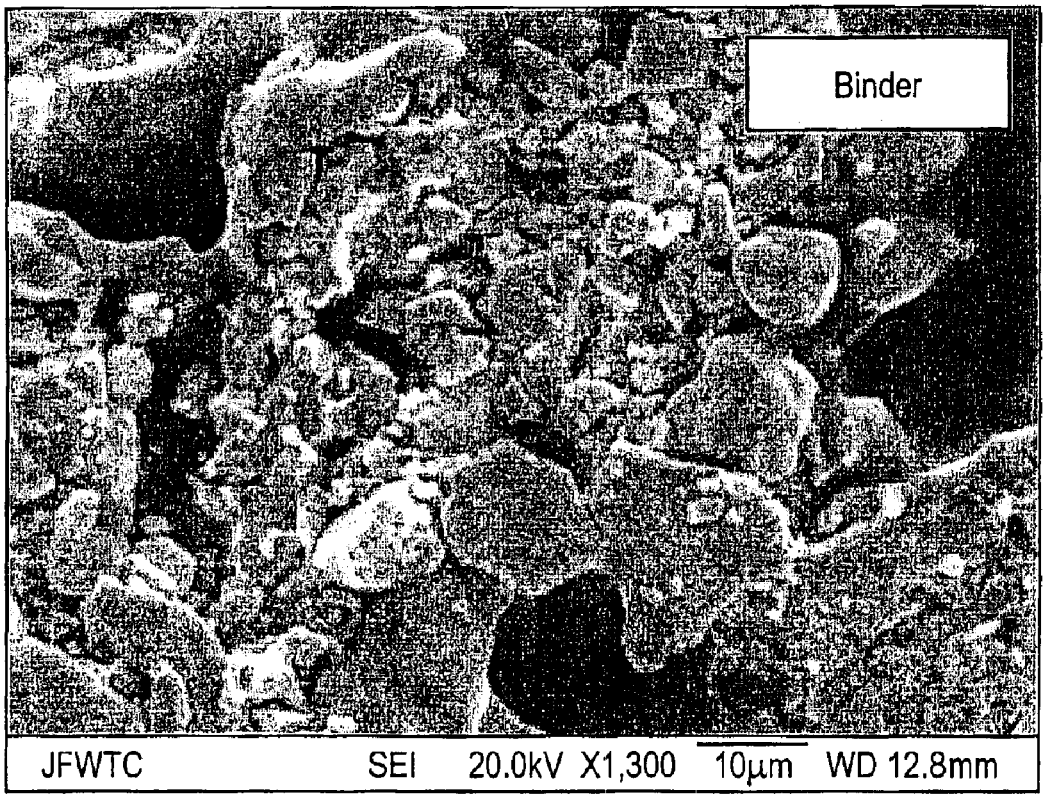
FIG. 13 is a scanning electron micrograph taken at a magnification of 1,300× and depicts the structure of Sample #5 from Table 2 having the composition $(Ba_{0.70}Ca_{0.10})_6Ta_2O_{11}$ upon exposure to organic binder.
Figure 14:
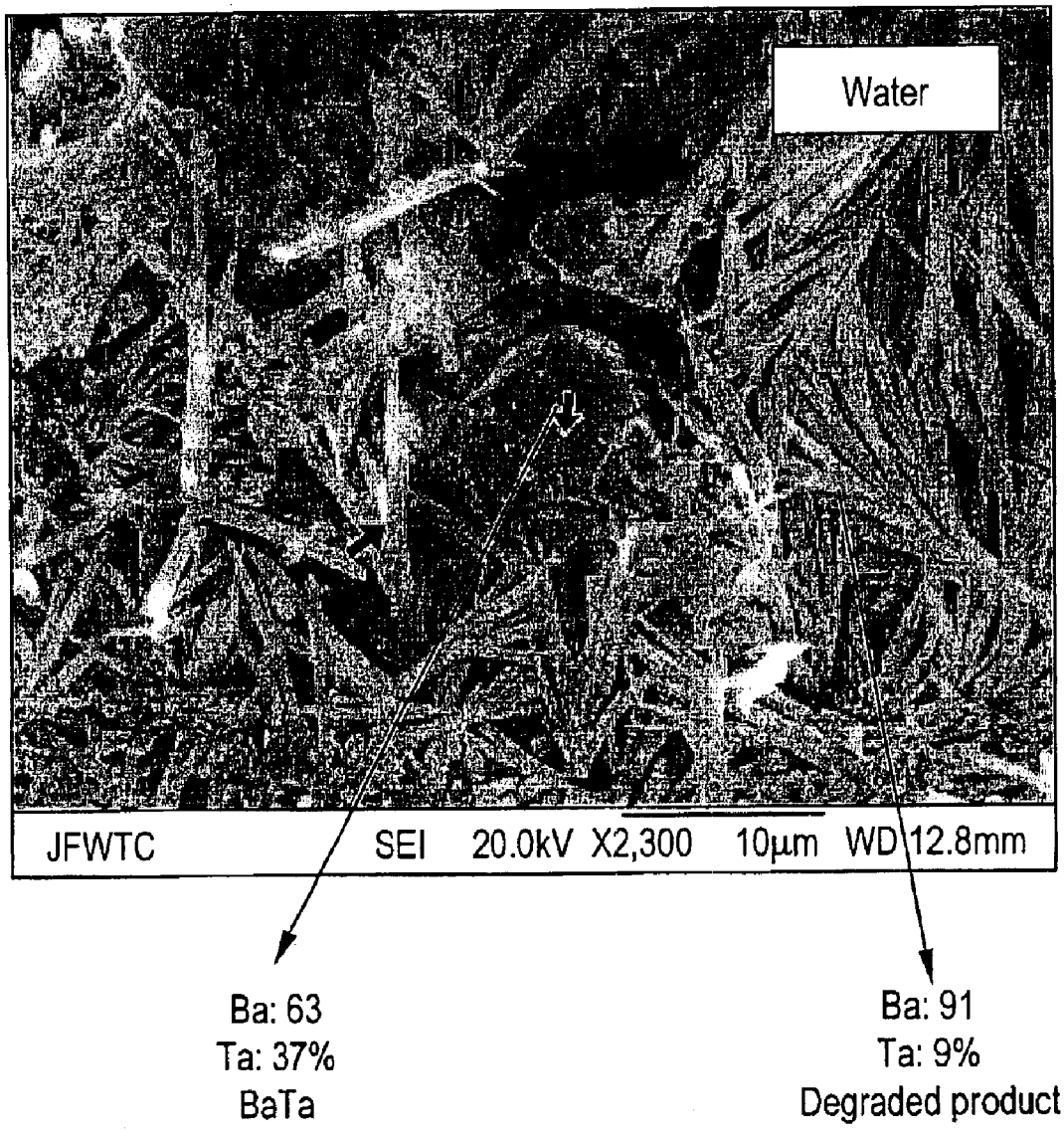
FIG. 14 is a scanning electron micrograph taken at a magnification of 1,300× and depicts the structure of Sample #5 from Table 2 having the composition $(Ba_{0.90}Ca_{0.10})_6Ta_2O_{11}$ upon exposure to water.

FIG. 12 reflects a phase diagram for a barium tantalate comprising barium, strontium, calcium and tantalum. The phase diagram was studied in order to determine the reason for the improvement in water stability when calcium was added to the barium tantalate composition. It was determined that the addition of calcium to the barium tantalate composition in an amount of about 25 to about 35 atomic percent promoted the conversion of a tetragonal phase to a cubic phase. The cubic phase demonstrates an increased resistance to water. FIG. 13 is a scanning electron micrograph taken at a magnification of 1,300× and depicts the structure of Sample #5 having the composition $(Ba_{0.90}Ca_{0.10})_6Ta_2O_{11}$, while FIG. 14 reflects the same sample upon exposure to water. FIG. 14 shows a clear change in the structure of the sample upon exposure to moisture. Xray analysis of the sample in FIG. 14 shows that there is a compositional change upon exposure to moisture. There is a reduction of the amount of tantalum during the conversion from a tetragonal structure to a cubic structure. The tantalum is reduced from 37 atomic percent to about 9 atomic percent, while the amount of barium is increased from 63 atomic percent to about 91 atomic percent.

Figure 15:
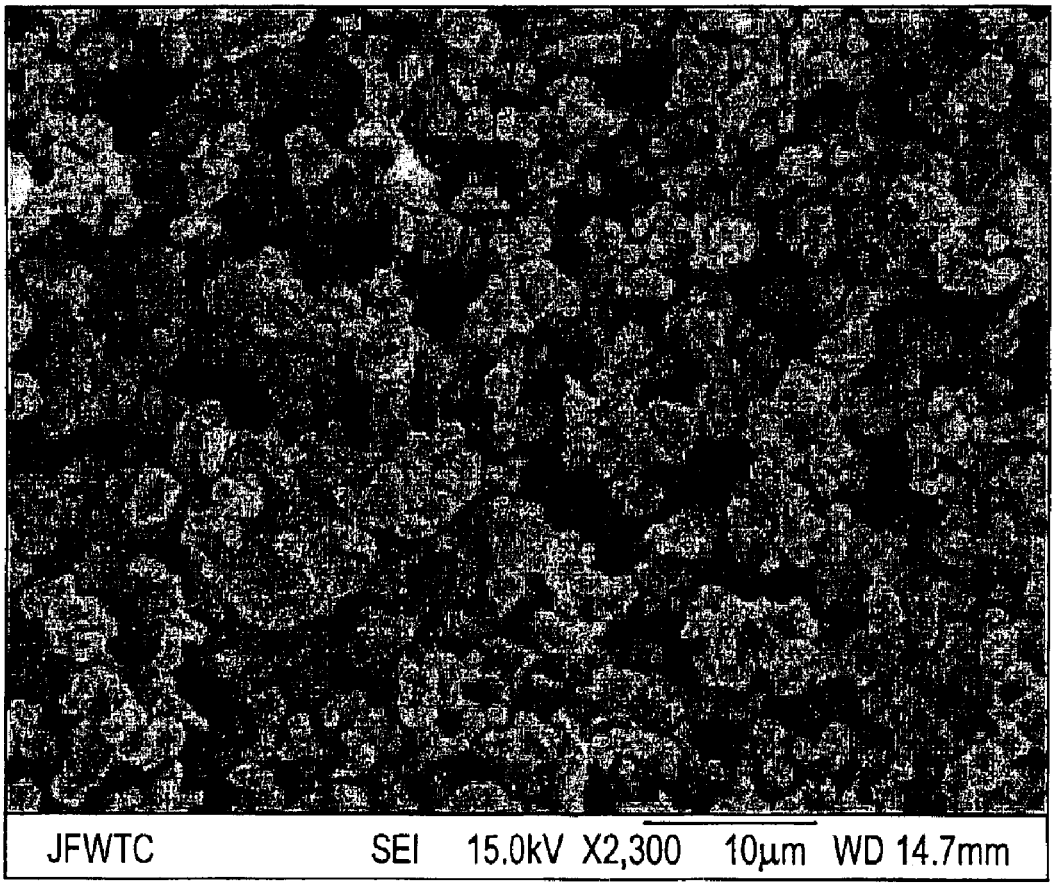
FIG. 15 is a scanning electron micrograph showing the particles formed by the composition of Sample #9 from Table 2 having the composition $(Ba_{0.70}Ca_{0.30})_6Ta_2O_{11}$.
Figure 16A:
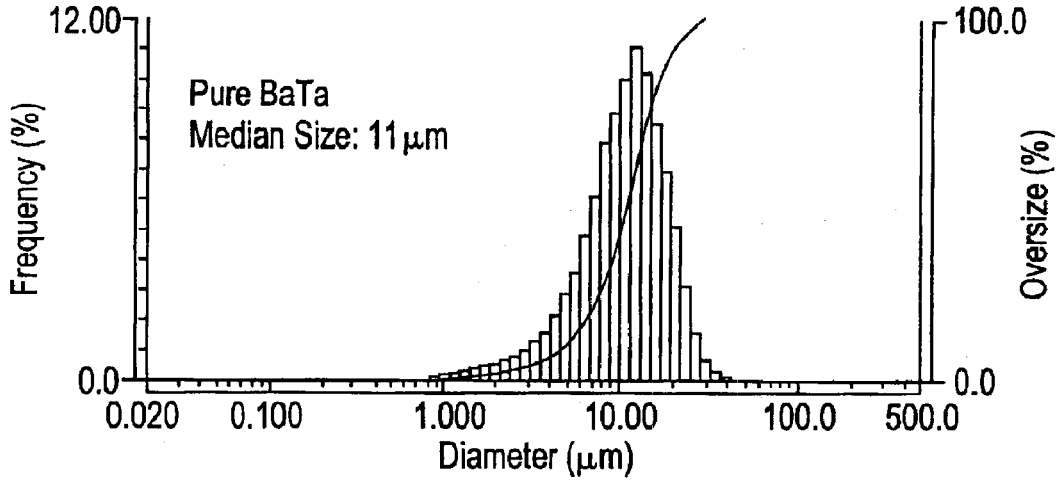
FIG. 16 is a graphical representation comparing the particle sizes of the composition of Sample #5 from Table 2 with the composition of Sample #9 from Table 2.
Figure 16B:
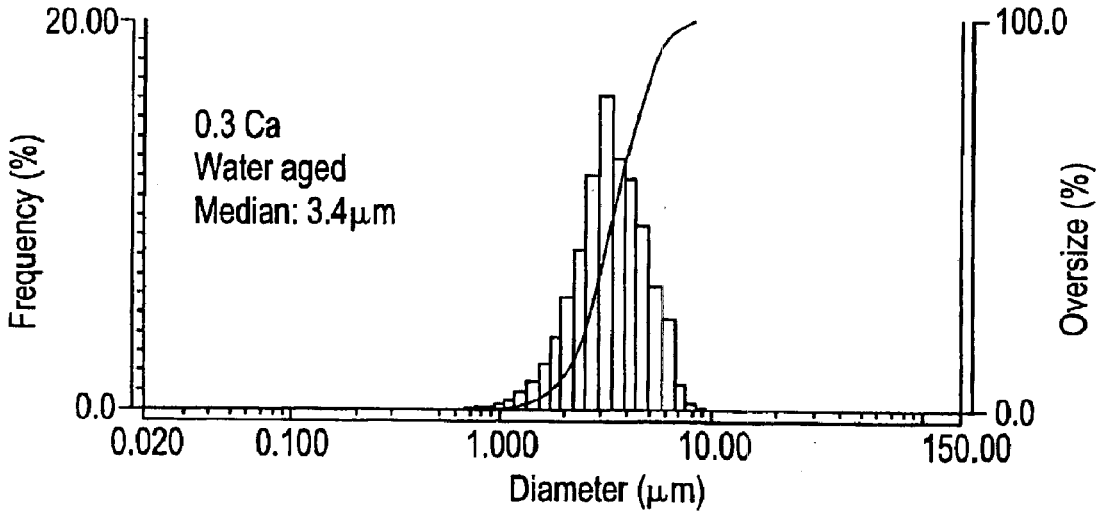

FIG. 15 is a scanning electron micrograph showing the particles formed by the composition of Sample #9. From the figure it can be seen that with the introduction of calcium in an amount of greater than or equal to about 0.25 atomic percent, the particulate structure becomes more fine. A comparison with the structure of FIG. 13 shows clearly that the composition of Sample #5 produces a much coarser structure than the composition of Sample #9. This difference in particle sizes is shown in FIG. 16, where it can be seen that the composition of Sample #5 has median particle size of 11 micrometers whereas the composition of Sample #9 has a median particle size of 3.4 micrometers. As detailed above, barium tantalates containing and amount of greater than or equal to about 25 atomic % have particle sizes of about 3 to about 4 micrometers and therefore need no further milling except for blending in binder and solvent to from the wet mixture.

From the above examples it may be seen that the barium tantalate compositions are generally stable in the binder and those compositions containing an amount of calcium greater than or equal to about 0.3 atomic percent are stable in water. In an exemplary embodiment, the barium tantalate compositions wherein x is present in an amount of about 0.25 to about 0.35 atomic percent is stable in water for a period greater than or equal to about 1 week, preferably greater than or equal to about 5 weeks, more preferably greater than or equal to about 3 months and even more preferably greater than or equal to about 6 months. The preferred value of x is 0.3 atomic percent.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electron emissive composition comprising:

a barium tantalate composition of the formula (I)

$$(Ba_{1-x}, Ca_x, Sr_p, D_q)_6(Ta_{1-y}, W_y, E_t, F_u, G_v, Ca_w)_2O_{(11\pm\delta)} \quad (I)$$

wherein δ is an amount of about 0 to about 6; and wherein D is either an alkali earth metal ion or an alkaline earth metal ion; E, F, and G are alkali earth metal ions, alkaline earth metal ions and/or transition metal ions; x is an amount of up to about 0.7; y is an amount of up to about 1; p and q are amounts of up to about 0.3; and t is an amount of about 0.05 to about 0.10; u is an amount of up to about 0.5; v is an amount of up to about 0.5 and w is an amount of up to about 0.25.

2. The composition of claim 1, wherein D is magnesium, E is zirconium, F is niobium, and G is titanium.

3. The composition of claim 1, wherein x is in an amount of about 0.25 to about 0.35, y is about 1 and p, q, t, u, v and w are each equal to 0.

4. The composition of claim 1, wherein x is in an amount of about 0.25 to about 0.35, and y, p, q, t, u, v and w are each equal to 0.

5. The composition of claim 1, wherein the barium tantalate composition comprises particles having a size of about 1 to about 20 micrometers.

6. An electrode manufactured by the composition of claim 1.

7. The composition of claim 1, wherein the composition further comprises a binder.

8. The composition of claim 7, wherein the binder is a thermoplastic resin, a thermosetting resin or a blend of a thermoplastic resin with a thermosetting resin.

9. The composition of claim 8, wherein the binder is nitrocellulose.

10. The composition of claim 1, wherein the composition further comprises a solvent.

11. The composition of claim 10, wherein solvent is propylene glycol mono-methyl ether acetate comprising about 1 to about 2 wt % denatured alcohol based on the total weight of the propylene glycol mono-methyl ether acetate and denatured alcohol.

12. A method for manufacturing an electron emissive composition comprising:

blending metal compounds in a stoichiometry effective to obtain at a barium tantalate composition of the formula (I)

$$(Ba_{1-x}, Ca_x, Sr_p, D_q)_6(Ta_{1-y}, W_y, E_t, F_u, G_v, Ca_w)_2O_{(11\pm\delta)} \quad (I)$$

where δ is an amount of about 0 to about 6; and wherein D is either an alkali earth metal or an alkaline earth metal ion; E, F, and G are alkali earth metal ion, alkaline earth metal ion and/or transition metal ion; x is an amount of up to about 0.7; y is an amount of up to about 1; p and q are amounts of up to about 0.3; and t is an amount of about 0.05 to about 0.10; u is an amount of up to about 0.5; v is an amount of up to about 0.5 and w is an amount of up to about 0.25.

13. The method of claim 12, wherein the metal compounds are oxides, peroxides, carbonates, nitrates, carboxylates sulfates, or chlorides of alkali earth metals, alkaline earth metals or transition metals.

14. The method of claim 12, wherein D is magnesium, E is zirconium, F is niobium, and G is titanium.

15. The method of claim 12, wherein the blending further comprises mechanically milling the metal compounds to a particle size of about 0.4 to about 8 micrometers.

16. The method of claim 12, wherein the blending further comprises adding a binder and a solvent to the metal compounds.

17. The method of claim 12, further comprising sintering the metal compounds to a temperature of about 1000° C. to about 1700° C.

18. The method of claim 16, further comprising sintering the metal compounds to a temperature of about 1000° C. to about 1700° C.

19. A method for manufacturing an electron emissive composition comprising:

blending a barium tantalate composition of the formula (I)

$$(Ba_{1-x}, Ca_x, Sr_p, D_q)_6(Ta_{1-y}, W_y, E_t, F_u, G_v, Ca_w)_2O_{(11\pm\delta)} \quad (I)$$

wherein δ is an amount of about 0 to about 6; and wherein D is either an alkali earth metal ion or an alkaline earth metal ion; E, F, and G are alkali earth metal ion, alkaline earth metal ion and/or transition metal ion; x is an amount of up to about 0.7; y is an amount of up to about 1; p and q are amounts of up to about 0.3; and t is an amount of about 0.05 to about 0.10; u is an amount of up to about 0.5; v is an amount of up to about 0.5 and w is an amount of up to about 0.25, with a binder; and sintering the barium tantalate composition with the binder at a temperature of about 1000° C. to about 1700° C.

20. The method of claim 19, wherein the blending further comprises adding a solvent to the barium tantalate composition.

21. The method of claim 19, wherein the binder is a thermoplastic resin, thermosetting resin or a combination of a thermoplastic resin with a thermosetting resin.

22. The method of claim 19, wherein the binder is nitrocellulose.

23. The method of claim 21, wherein the thermoplastic resin is polyacetal, polyacrylic, styrene acrylonitrile, acrylonitrile-butadiene-styrene, polycarbonate, polystyrene, polyethylene, polypropylene, polyethylene terephthalate, polybutylene terephthalate, polyamide, polyamideimides, polyarylates, polyurethanes, polyetherimide, polytetrafluoroethylene, fluorinated ethylene propylene, perfluoroalkoxy polymers, polyethylene glycol, polypropylene glycol, polyether, polychlorotrifluoroethylene, polyvinylidene fluoride, polyvinyl fluoride, polyetherketone, polyether etherketone, polyether ketone ketone, nitrocellulose, cellulose, lignin or a combination comprising at least one of the foregoing thermoplastic resins.

24. The method of claim 21, wherein the thermosetting resin is polyurethane, epoxy, phenolic, polyesters, polyamides, silicones, or combinations comprising at least one of the foregoing thermosetting resins.

25. The method of claim 19, wherein the solvent is propylene glycol mono-methyl ether acetate with denatured alcohol, and wherein the denatured alcohol is present at about 1 to about 2 wt % based on the total weight of the propylene glycol mono-methyl ether acetate and denatured alcohol.

26. An electrode comprising a substrate; and a barium tantalate composition disposed upon the substrate, wherein the barium tantalate composition has the formula (I)

$$(Ba_{1-x}, Ca_x, Sr_p, D_q)_6(Ta_{1-y}, W_y, E_t, F_u, G_v, Ca_w)_2O_{(11\pm\delta)} \quad (I)$$

wherein δ is an amount of about 0 to about 6; and wherein D is either an alkali earth metal or an alkaline earth ion; E, F, and G are alkali earth metal ion, alkaline earth metal ion and/or transition metal ion; x is an amount of up to about 0.7; y is an amount of up to about 1; p and q are amounts of up to about 0.3; and t is an amount of about 0.05 to about 0.10; u is an amount of up to about 0.5; v is an amount of up to about 0.5 and w is an amount of up to about 0.25.

27. The electrode of claim 26, wherein the substrate is tungsten and wherein the barium tantalate composition is applied to the substrate as a coating.

28. The electrode of claim 26, wherein the electrode is used in linear fluorescent lamps, compact fluorescent lamps, circular fluorescent lamps, high intensity discharge lamps, flat panel displays, mercury free and xenon lamps.

* * * * *